US009266227B2

(12) United States Patent
Schroeder et al.

(10) Patent No.: US 9,266,227 B2
(45) Date of Patent: Feb. 23, 2016

(54) TOOL FOR OPERATING TIRE CHAIN TENSIONERS AND METHOD OF USING THE SAME

(71) Applicants: Christopher Joseph Schroeder, Upper Tantallon (CA); Tracey Lee Schroeder, Upper Tantallon (CA)

(72) Inventors: Christopher Joseph Schroeder, Upper Tantallon (CA); Tracey Lee Schroeder, Upper Tantallon (CA)

( * ) Notice: Subject to any disclaimer, the term of this patent is extended or adjusted under 35 U.S.C. 154(b) by 251 days.

(21) Appl. No.: 14/177,745

(22) Filed: Feb. 11, 2014

(65) Prior Publication Data

US 2015/0224632 A1 Aug. 13, 2015

(51) Int. Cl.

| | |
|---|---|
| ***B25B 13/50*** | (2006.01) |
| ***B25B 25/00*** | (2006.01) |
| ***B25B 27/22*** | (2006.01) |
| ***B25B 13/48*** | (2006.01) |
| ***B25B 27/00*** | (2006.01) |

(52) U.S. Cl.

CPC ..... *B25B 27/22* (2013.01); *B25B 13/48* (2013.01); *B25B 25/00* (2013.01); *B25B 27/0035* (2013.01)

(58) Field of Classification Search

CPC ..... B60C 27/06; B60C 27/08; B60C 27/10; B60C 27/14; B60C 27/22; B60C 27/0035

See application file for complete search history.

(56) References Cited

U.S. PATENT DOCUMENTS

| | | | | | |
|---|---|---|---|---|---|
| 1,179,456 | A * | 4/1916 | Reichman | B60C 27/14 | 81/15.8 |
| 1,437,158 | A * | 11/1922 | Snodgrass | B60C 27/08 | 24/69 TT |
| 1,537,559 | A * | 5/1925 | Staggers | B25B 27/22 | 81/15.8 |
| 1,554,874 | A * | 9/1925 | Michael | B25B 27/22 | 188/264 A |
| 1,642,542 | A * | 9/1927 | Finley | B25B 27/22 | 81/15.8 |
| 1,839,715 | A * | 1/1932 | Terrell | B60C 27/08 | 81/15.8 |
| 3,675,897 | A * | 7/1972 | Smith | B25B 27/22 | 254/249 |
| 5,048,376 | A * | 9/1991 | Faanes | B60C 27/06 | 81/15.8 |
| 5,570,619 | A * | 11/1996 | Goswick | B60T 17/221 | 81/484 |
| 7,007,572 | B2 * | 3/2006 | Woodworth | B60C 27/00 | 152/213 R |

* cited by examiner

*Primary Examiner* — David B Thomas
(74) *Attorney, Agent, or Firm* — Sand & Sebolt

(57) ABSTRACT

A tool for operating a vehicle tire chain tensioner and a method of using the same. The tool is a member having spaced apart first and second ends. The first end is configured to engage a first style of chain tensioner and the second end is configured to engage a second style of chain tensioner. The first end includes a leg extending outwardly at ninety degrees from the member in a first direction; and the second end includes spaced apart first and second arms that extend outwardly at ninety degrees from the member in a second direction. The member, leg, and first and second arms are all aligned in the same plane. The leg's free end is complementary to a recess defined in the first style of chain tensioner. A section of the second style of chain tensioner is received in a gap defined between the first and second arms.

20 Claims, 9 Drawing Sheets

TOOL FOR OPERATING TIRE CHAIN TENSIONERS AND METHOD OF USING THE SAME

BACKGROUND OF THE INVENTION

1. Technical Field

This invention relates generally to vehicle tire chains used for winter driving. More particularly, this invention relates to equipment for use in conjunction with tensioners and fasteners for vehicle tire chains. Specifically, this invention is directed to a tool that has a first end that is configured to engage a first style of tire chain tensioner or fastener and a second end that is configured to engage a second style of tire chain tensioner or fastener.

2. Background Information

Vehicles used in snowy or icy winter conditions often have to have chains engaged on the tires so that there is adequate traction to keep the vehicle on the road. During the installation process, the chains are laid on the road or wrapped partially around the tires, the vehicle is slowly driven onto the chains, and then the operator will pull each chain up and around the associated tire. It is then necessary to fasten the ends of the chain together and tension the chain so that it tightly grips the tire.

There are a number of different components that may be used to fasten the ends of the chain together and other components which can be used to tension the chain. A first style of tensioner that has gained recent popularity is known as a "cam tensioner". This device is a "C-shaped" plate with an arcuate slot defined in it. The plate is secured between two adjacent links in the chain. A small rectangular recess or hole is provided in the plate and an adjuster tool is inserted into this hole to rotate the plate through about 180° to draw the links attached to the plate toward each other.

An earlier style of fastener or tensioner is a generally S-shaped plate having a first curved region and a second curved region at opposite ends of the plate and an arcuate section between the first and second regions. A first link is slipped into the first region of the fastener and another link is slipped onto the arcuate section. The fastener plate is then rotated through about 90° and the second region engages a third link. The first, second and third links are all drawn toward each other, thereby both fastening and tensioning the chain. In order to install this style of fastener/tensioner, an installer will frequently use their hands or pliers to manipulate the plate. There is a risk of the plate slipping as it is manipulated as described above and this may cause both frustration and injury to the installer.

Both of the older style fasteners/tensioners and the newer style tensioners will be further referred to herein by the term "tensioner".

There remains a need in the art for an improved tool for use with fasteners and tensioners of vehicle tire chains.

SUMMARY

A tool for operating a vehicle tire chain tensioner and a method of using the same is disclosed. In one aspect, the invention may provide a tool comprising a member having spaced apart first and second ends. The first end is configured to engage a first style of chain tensioner and the second end is configured to engage a second style of chain tensioner. The first end includes a leg extending outwardly at ninety degrees from the member in a first direction; and the second end includes spaced apart first and second arms that extend outwardly at ninety degrees from the member in a second direction. The member, leg, and first and second arms are all aligned in the same plane. The leg's free end is complementary to a recess defined in the first style of chain tensioner. A section of the second style of chain tensioner is received in a gap defined between the first and second arms.

In particular, the tool is configured so that it may be used with either of the older style tensioners or with the newer style tensioners described in the Background above. This new, universal chain tensioner tool has a first end which includes a rectangular member for engagement with newer style tensioners and has a second end that is forked for engagement with a section of the older style tensioners and includes button caps thereon to prevent the section of the tensioner from slipping out of the gap between the arms of the forked end.

In another aspect, the invention may provide a method of adjusting the tension in a tire chain installed on a vehicle tire; where the tire chain includes a tensioner; the method comprising the steps of:

providing an adjuster tool including a member having a first end and a second end; wherein the first end of the member is configured to engage a first style of vehicle tire chain tensioner and the second end of the member is configured to engage a second style of vehicle tire chain tensioner;

determining which of the first and second style of vehicle tire chain tensioners is engaged with the vehicle tire;

engaging the determined one of the first and second style vehicle tire chain tensioners with the appropriate one or the other of the first and second ends of the adjuster tool.

In another aspect, the invention may provide the further step of: rotating the adjuster tool and thereby the determined one of the first and second style vehicle tire chain tensioners in a first direction to increase tension in the tire chain or in a second direction to reduce the tension in the tire chain. The step of rotating the adjuster tool further includes rotating the adjuster tool through about 180° for adjustment of the first style of tire chain tensioner or through about 90° for adjustment of the second style of tire chain tensioner.

In another aspect, where the determined one of the tensioners is the first style of vehicle tire chain tensioner; the invention may further provide the step of engaging this first style of vehicle tire chain tensioner which includes inserting a complementary free end of a leg at a first end of the adjuster tool into a recess in the first style of vehicle tire chain tensioner. If the determined one of the tensioners is the second style of vehicle tire chain tensioner; the invention may further provide the step of engaging this second style of vehicle tire chain tensioner which includes capturing a section of the second style of vehicle tire chain tensioner in a gap defined between a first arm and a second arm extending outwardly from a second end of the adjuster tool.

BRIEF DESCRIPTION OF THE SEVERAL VIEWS OF THE DRAWINGS

A sample embodiment of the invention, illustrative of the best mode in which Applicant contemplates applying the principles, is set forth in the following description, is shown in the drawings and is particularly and distinctly pointed out and set forth in the appended claims.

Similar numbers refer to similar parts throughout the drawings.

DETAILED DESCRIPTION

Figure 1:
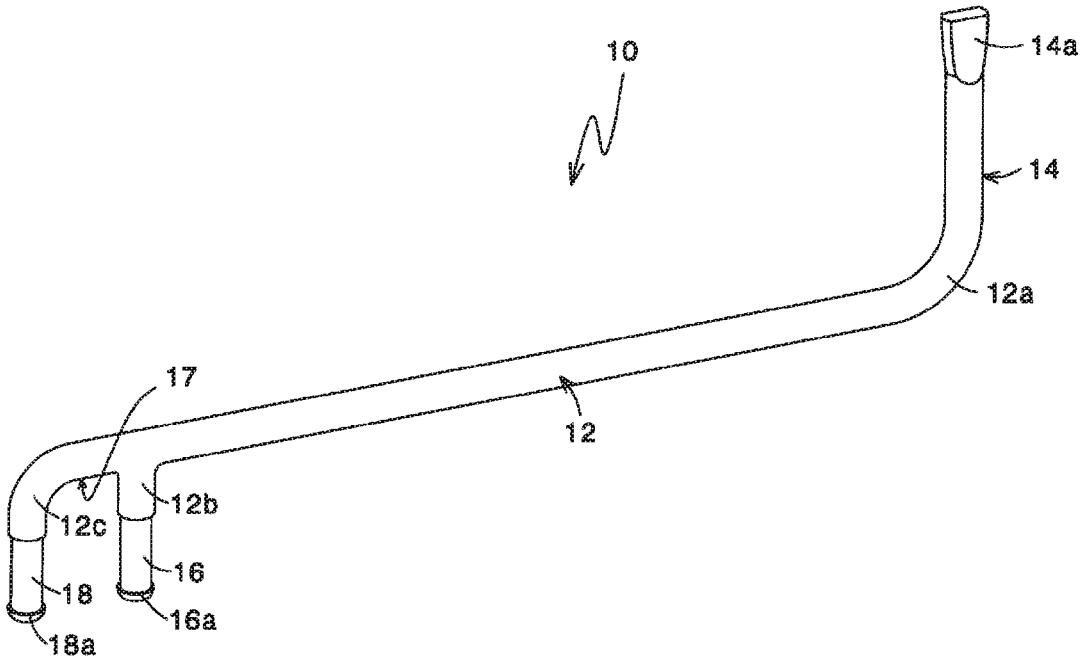
FIG. 1 is a perspective view of a tire chain adjuster in accordance with an aspect of the invention.
Figure 2:
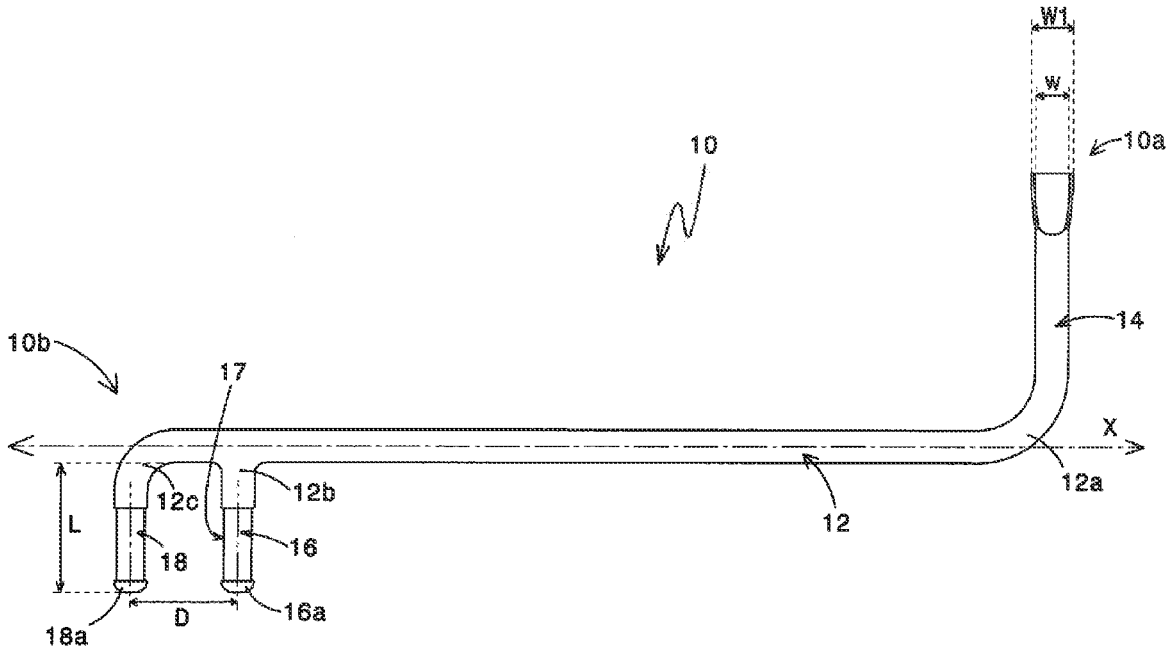
FIG. 2 is a front elevation of the adjuster of FIG. 1.
Figure 3:
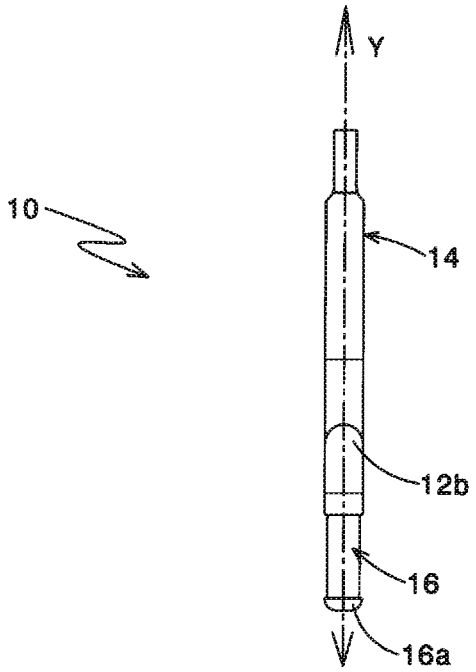
FIG. 3 is a left side view of the adjuster as shown in FIG. 1.

Referring to FIGS. 1-3, there is shown a tire chain adjuster tool in accordance with an aspect of the present invention, generally indicated at 10. Tool 10 is a unitary component that has a first end 10*a* and a second end 10*b* and is generally Z-shaped when viewed from the front or back (FIG. 2). Preferably, tool is fabricated from hardened steel or some other strong and durable material, particularly a material that will make the tool resistant to damage through to exposure to water and ice-melting compounds such as salt.

Tool 10 includes a central region 12 having a first elbow 12*a* at one end and two elbows 12*b*, 12*c* at the other end. A leg 14 is connected to central region 12 via first elbow 12*a*. A first arm 16 is connected to central region 12 via second elbow 12*b* and a second arm 18 is connected to central region via third elbow 12*c*. Second end 10*a* of tool 10 thus is "forked" in configuration.

Each of the first, second, and third elbows are substantially right-angled elbows, Thus, each of the leg 14 and first and second arms 16, 18 is positioned generally at right angles to a longitudinal axis "X" (FIG. 2) of central region 12. As is evident from FIG. 1, leg 14 extends outwardly from central region in a first direction and first and second arms 16, 18 extend outwardly from central region 12 in a second and opposite direction from leg 14. FIG. 3 shows that central region 12, leg 14, first arm 16 and second arm 18 are all disposed in generally the same plane, indicated as plane "Y".

Leg 14 has a free end 14*a* disposed a distance from elbow 12*a*. This free end 14*a* has is of a different cross-sectional shape to the rest of leg 14. In accordance with an aspect of the invention and as illustrated in any of FIG. 5, free end 14*a* has a cross-sectional shape that is complementary to a recess 20 defined in a chain tensioner 22. The style of chain tensioner or tensioner shown illustrated as component 22 is also known as a "cam tightener". In accordance with currently known chain tensioners 22, recess 20 is generally of a rectangular or square shape and, consequently, free end 14*a* of leg 14 is generally rectangular or square in cross-section. Furthermore, free end 14*a* of leg 14 is complementary in size to recess 20, being only slightly smaller in dimensions than recess 20 so that free end 14*a* is insertable into recess 22. It will be understood that if the shape of the recess 20 in chain tensioner 22 is different to rectangular or square, then free end 14*a* of leg 14 will be similarly and complementarily configured to that recess 20.

In accordance with an aspect of the present invention, free end 14*a* of leg 14 flares outwardly so that it is narrower closer to central region 12 and wider further away from central region 12. As shown in FIG. 2, the width of free end 14*a* closer to central region 12 is indicated by the reference character "W" and the width of the free end 14*a* further from central region 12 is indicated by the reference character "W1". The width "W1" is greater than the width "W". This change in width is to ensure that free end 14*a* will adequately be able to engage within recess 20 of chain tensioner 22 as will be further described herein.

First and second arms 16, 18 are spaced a distance "D" apart from each other such that a gap 17 is defined therebetween. Preferably, first and second arms 16, 18 are generally of the same length "L" and the arms 16, 18 are disposed substantially parallel to each other. In accordance with an aspect of the present invention, the free end 16*a*, 18*a* of each of the first and second arms 16, 18 is of a diameter greater than the rest of the arm. Thus, the free ends 16*a*, 18*a* are bulbous. These bulbous free ends 16*a*, 18*a* aid in preventing tool 10 from slipping during use. The configuration of this bulbous free end 16*a*, 18*a* can take any of a number of forms. In the drawings attached hereto, free ends 16*a*, 18*a* are shown as a mushroom-cap type shape but it will be understood that any differently shaped free ends 16*a*, 18*a* could be utilized to prevent section 36*b* of tensioner 36 from slipping out of gap 17.

Figure 4:
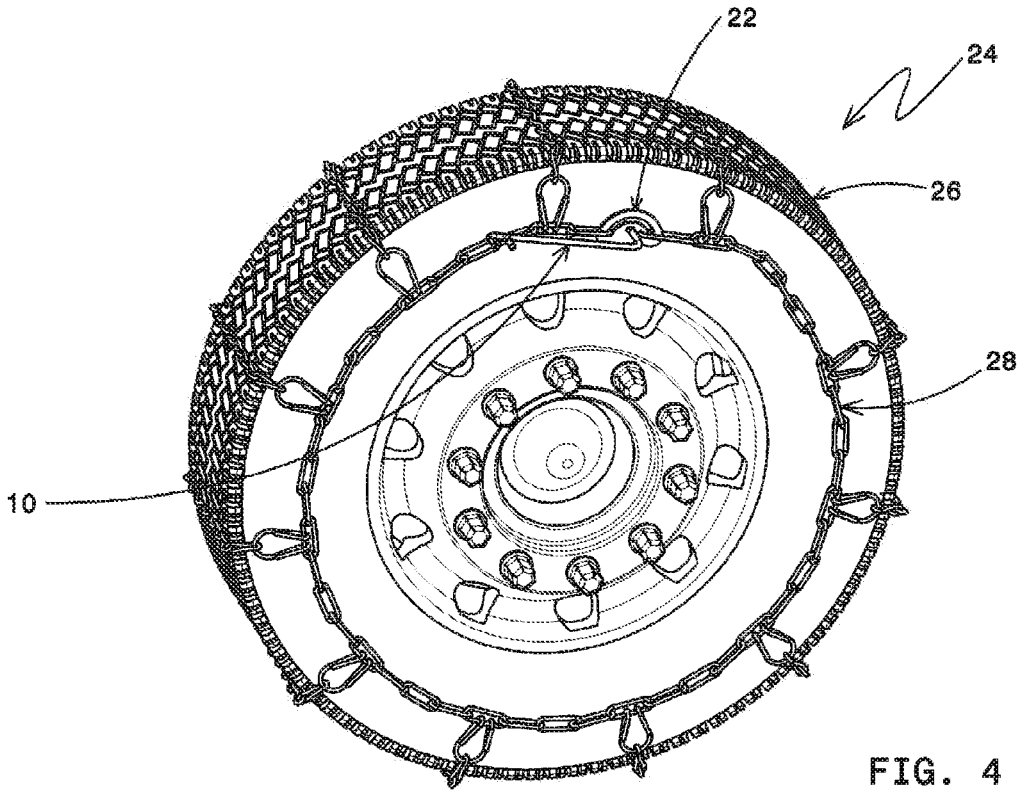
FIG. 4 is a perspective view of a vehicle wheel with a chain engaged about the tire and showing the adjuster in accordance with an aspect of the present invention engaged with a newer style tensioner provided on the chain.
Figure 5:
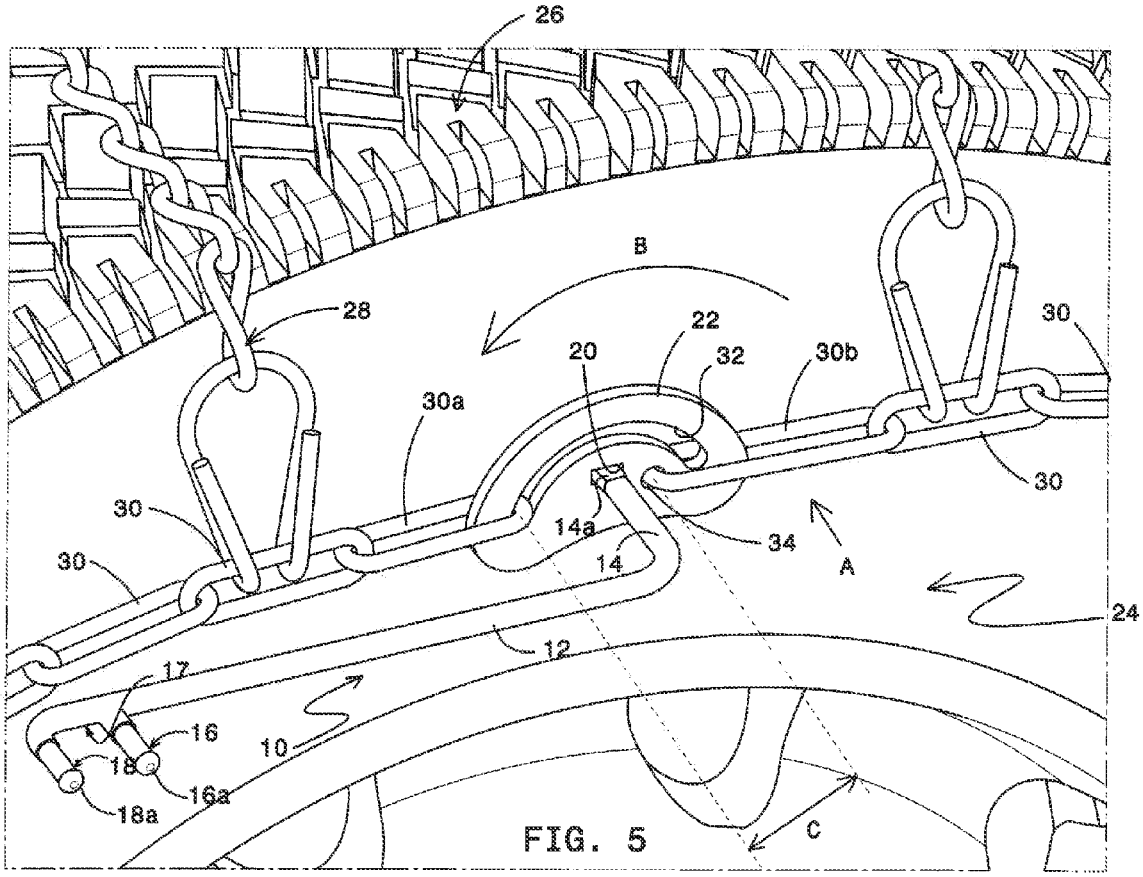
FIG. 5 is an enlarged perspective view of a portion of the vehicle wheel showing the adjuster engaged with the tensioner when the tensioner is in a first unadjusted position.
Figure 6:
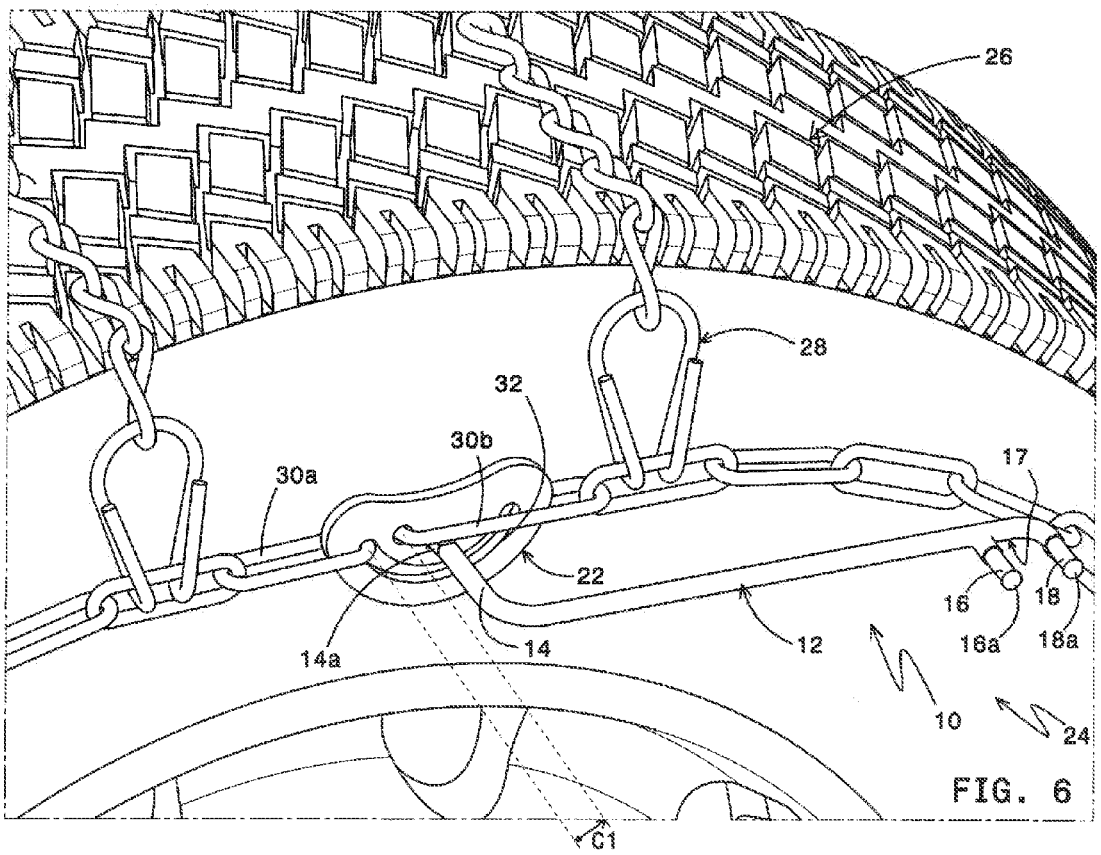
FIG. 6 is an enlarged perspective view of the portion of the vehicle wheel of FIG. 5 showing the adjuster engaged with the tensioner when the tensioner is in a second adjusted position.

Referring to FIGS. 4-6 there is shown a wheel 24 with a tire 26 mounted thereon and a chain 28 engaged about tire 26. Chain 28 is comprised of a plurality of links 30 that are interlockingly linked to each other. Chain 28 includes a tensioner 22 which secures two adjacent links 30 to each other. The tensioner 22 illustrated herein is well known in the art and is referenced earlier in this description as a "newer-style" tensioner. Tensioner 22 includes an arcuate cam slot 32, recess 20 and a through-hole 34. A first one of the links engaged with tensioner 22 in indicated in FIG. 5 as link 30*a* and a second one of the links engaged with tensioner 22 is indicated as link 30*b*. link 30*a* is engaged in slot 32 and link 30*b* is engaged in hole 34. Tensioner 22 thus forms an integral part of chain 28. It should be noted from FIG. 5 that the distance between the portion of link 30*a* that is disposed in slot 32 and the portion of the link 30*b* that is disposed in hole is indicated by the reference character "C". "C" indicates the distance between links 30*a* and 30*b* when chain 28 is in an untensioned condition.

If it is decided that the tension in chain 28 is insufficient and chain 28 is not adequately gripping onto tire 26, then the operator needs to adjust the tension. This is done by rotating tensioner 22 from the first position shown in FIG. 5 to the second position shown in FIG. 6. The rotation is accomplished by engaging free end 14*a* of leg 14 of tool 10 in recess 20 in tensioner 22. Free end 14*a* is slid into recess 22 in the direction of arrow "A" in FIG. 5. The installer will then rotate central region 12 of tool 10 in either of a clockwise or an anticlockwise direction. FIG. 5 shows central region 12 being rotated in a clockwise direction indicated by arrow "B". Because of the tight engagement of first end 14*a* in recess 20, as central region 12 is rotated the tensioner 22 will rotate in unison with central region and will thus also move in the direction of arrow "B". The portion of link 30*b* engaged in hole 34 acts as a pivot for tensioner 22. As tensioner 22 rotates with member 12, the portion of link 30*a* engaged in slot 32 is caused to slide therealong.

When tensioner 22 reaches the second, tensioned position, shown in FIG. 6, the distance between the portion of link 30*a* in slot 32 and the portion of link 30*b* in hole 34 is indicated by the reference character "C1". As is evident when comparing FIGS. 5 and 6, the distance "C1" is smaller than the distance "C". Consequently, links 30*a* and 30*b* have been drawn toward each other and the tension in chain 28 has thus been increased. Chain 28 thus more closely is retained adjacent tire 26. Tool 10 is then disengaged from tensioner 22 by sliding free end 14*a* out of recess 20 on tensioner 22.

Figure 7:
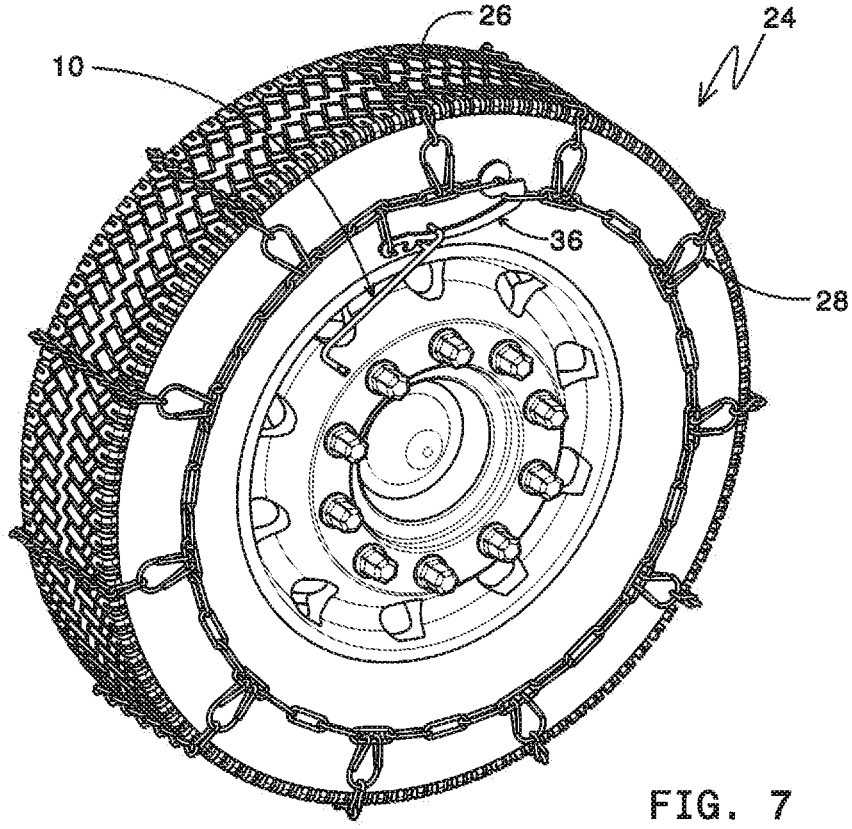
FIG. 7 is a perspective view of a vehicle wheel with a chain engaged about the tire and showing the adjuster in accordance with an aspect of the present invention engaged with an older style tensioner provided on the chain.
Figure 8:
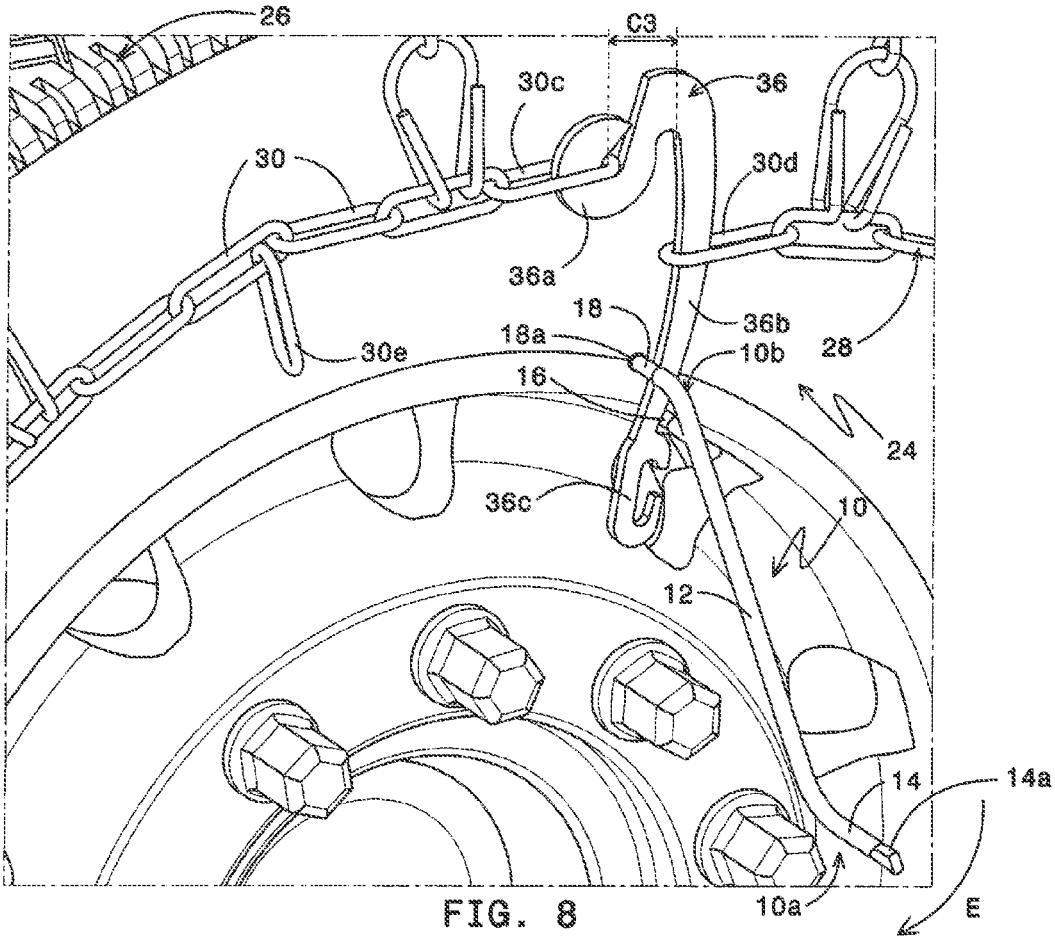
FIG. 8 is an enlarged perspective view of a portion of the vehicle wheel showing the adjuster engaged with the tensioner when the tensioner is in a first unadjusted position.
Figure 9:
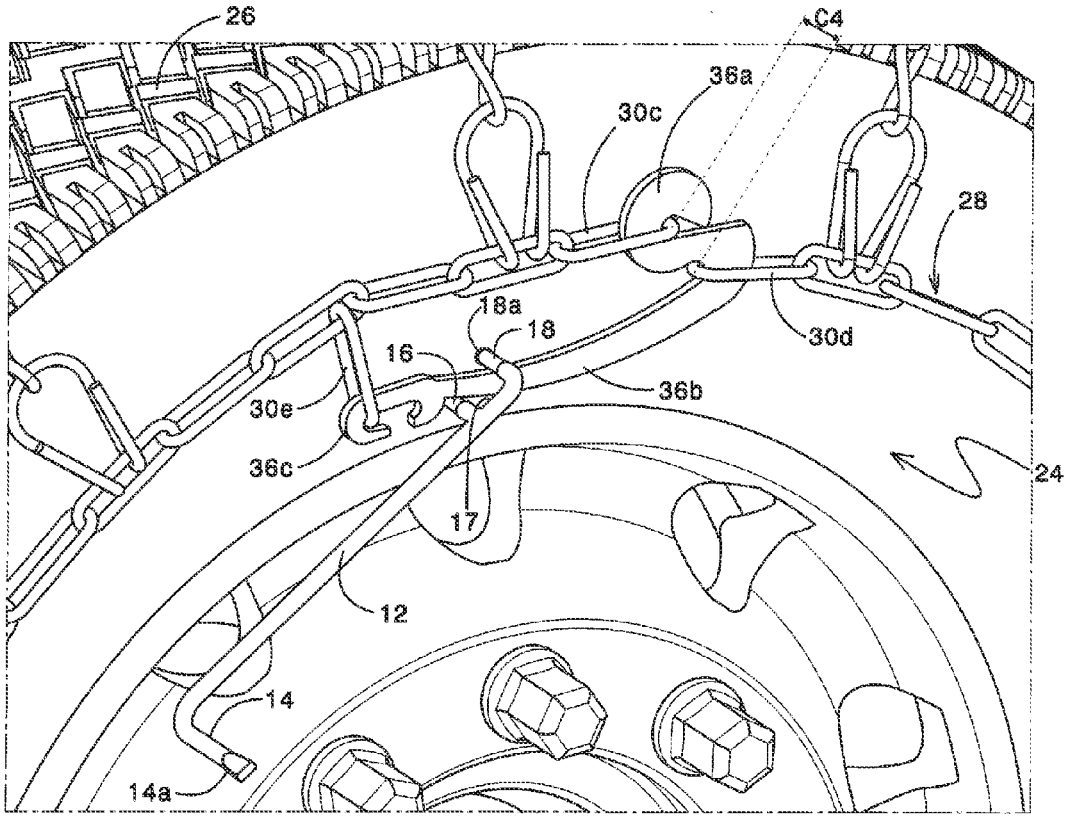
FIG. 9 is an enlarged perspective view of the portion of the vehicle wheel showing the adjuster engaged with the tensioner when the tensioner is in a second adjusted position.

Referring to FIGS. 7-9, there is shown a wheel 24 with a tire 26 mounted thereon and a chain 28 engaged about tire 26. Chain 28 is comprised of a plurality of links 30 that are interlockingly linked to each other. Chain 28 includes a tensioner 36 which secures two adjacent links 30 to each other. The tensioner 36 illustrated herein is well known in the art and is referenced earlier in this description as an "older-style" tensioner. Tensioner 36 includes a first section 36*a*, a second section 36*b* and a third section 36*c*. First section 36*a* engages a first link 30*c* of chain 28 and second section 36*b* engages a second link 30*d* of chain 28. Chain 28 further includes a tensioning link 30*e* that is only engaged with one of the other links 30 and hangs freely from chain 28. Third section 36*c* of tensioner 36 is configured to engage the tensioning link 30*e* by it is necessary to rotate tensioner 36 in order to make this necessary engagement so that chain 28 is secured around tire 26 and is tensioned correctly.

In accordance with an aspect of the invention, second end 10*a* of tool 10 is used to engage and rotate tensioner 36 from a first position (FIG. 8) to a second position (FIG. 9). Tool 10 is positioned so that second section 36*b* of tensioner 36 is received in gap 17 between arms 16 and 18. Tool 10 is then rotated in the direction of arrow "E" from the first position shown in FIG. 8 to the second position shown in FIG. 9. Because of the configuration of first and second sections 36*a*, 36*b* of tensioner 36, as tool 10 is rotated in the direction of arrow "E", tensioner 36 is also rotated in the direction of arrow "B". During rotation of tool 10 and thus tensioner 36, the bulbous free ends 16*a*, 18*a* keep tensioner 36 from sliding out of gap 17. Tensioner 36 is manipulated using tool 10 until the link 30*e* is engaged by the "C-shaped" third section 36*c* of tensioner 36. At this point, tensioner 36 secures one part of chain 28 to another. Furthermore, the distance "C2" (FIG. 8) between links 30*c* and 30*d* is reduced to "C3" (FIG. 9) and the chain 28 is thus tensioned. Tool 10 is then disengaged from tensioner 36 by sliding second end 10*b* thereof off section 36*b*.

A method of adjusting the tension in a tire chain installed on a vehicle tire includes the steps of:

providing an adjuster tool 10 including a member 12 having a first end 10*a* and a second end 10*b*; wherein the first end 10*a* of the member 12 is configured to engage a first style of vehicle tire chain tensioner 22 and the second end 10*b* of the member 12 is configured to engage a second style of vehicle tire chain tensioner 36;

determining which of the first and second style of vehicle tire chain tensioners 22, 36 is engaged with the vehicle tire 26;

engaging the determined one of the first and second style vehicle tire chain tensioners 22, 36 with the appropriate one or the other of the first and second ends 10, 10*b* of the adjuster tool 10.

The method further comprises the step of:

rotating the adjuster tool 10 and thereby the determined one of the first and second style vehicle tire chain tensioners 22, 36 in a first direction "B" or "E" to increase tension in the tire chain 28 or in a second direction (opposite directions to "B" or "E") to reduce the tension in the tire chain 28.

The method further comprises the step of:

rotating the adjuster tool 10 further includes rotating the adjuster tool 10 through about 180° for the first style vehicle tire chain tensioner 22 (the position shown in FIG. 5 to the position shown in FIG. 6) or through about 90° for the second style vehicle tire chain tensioner 36 (the position shown in FIG. 8 to the position shown in FIG. 9).

The method for the first style of vehicle tire chain tensioner also includes the step of inserting a complementary free end 14*a* of a leg 14 at a first end 10*a* of the adjuster tool 10 into a recess 20 in the first style of vehicle tire chain tensioner 22.

The method for the second style of vehicle tire chain tensioner 36 includes the step of capturing a section 36*b* of the second style of vehicle tire chain tensioner 36 in a gap 17 defined between a first arm 16 and a second arm 18 extending outwardly from a second end 10*b* of the adjuster tool 10.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the preferred embodiment of the invention are an example and the invention is not limited to the exact details shown or described.

The invention claimed is:

1. A tool for operating a vehicle tire chain tensioner; said tool comprising:

a member having a first end and a second end; wherein the first end of the member is adapted to engage a first style of vehicle tire chain tensioner and the second end of the member is adapted to engage a second style of vehicle tire chain tensioner.

2. The tool as defined in claim 1, wherein the first end of the member includes a leg that extends outwardly from the member at an angle relative thereto; and wherein the leg has a free end adapted to engage the first style of vehicle tire chain tensioner.

3. The tool as defined in claim 2, wherein the angle that the leg extends outwardly from the member is about ninety degrees.

4. The tool as defined in claim 2, wherein the free end of the leg is of a cross-section that is adapted to be complementary to a recess defined in the first style of vehicle tire chain tensioner.

5. The tool as defined in claim 4, wherein the free end of the leg is of a rectangular or square cross-section.

6. The tool as defined in claim 2, wherein the free end of the leg tapers in a direction extending toward the member.

7. The tool as defined in claim 2, wherein the free end of the leg is spaced a distance outwardly away from the member.

8. The tool as defined in claim 1, wherein the second end of the member is forked and includes a first arm and a second arm extending outwardly from the member.

9. The tool as defined in claim 8, wherein each of the first arm and the second arm comprises a shaft that is integral with the member and has a diameter; wherein the shaft has a terminal end and the terminal end is of a greater diameter than the diameter of the shaft.

10. The tool as defined in claim 9, wherein the terminal end is of a mushroom-cap shape.

11. The tool as defined in claim 1, wherein the first arm is spaced along the member a distance from the second arm such that a gap is defined between the first and second arms, and wherein the gap is sized and adapted to receive a region of the second style of vehicle tire chain tensioner therein.

12. The tool as defined in claim 11, wherein one or both of the first and second arms extends outwardly at ninety degrees relative to the member.

13. The tool as defined in claim 12, wherein the first end of the tool includes a leg that extends outwardly from the member in a first direction and the first and second arms extend outwardly from the member in a second direction.

14. The tool as defined in claim 13, wherein the member, the first arm, the second arm, and the leg are all aligned in the same plane.

15. The tool as defined in claim 1, wherein the member is elongate and the first and second ends are spaced a distance apart from each other and are offset relative to each other.

16. A method of adjusting the tension in a tire chain installed on a vehicle tire; where the tire chain includes a tensioner; the method comprising the steps of:

providing an adjuster tool including a member having a first end and a second end; wherein the first end of the member is configured to engage a first style of vehicle tire chain tensioner and the second end of the member is configured to engage a second style of vehicle tire chain tensioner;

determining which of the first and second style of vehicle tire chain tensioners is engaged with the vehicle tire;

engaging the determined one of the first and second style vehicle tire chain tensioners with the appropriate one or the other of the first and second ends of the adjuster tool.

17. The method as defined in claim 16, further comprising the step of:

rotating the adjuster tool and thereby the determined one of the first and second style vehicle tire chain tensioners in a first direction to increase tension in the tire chain or in a second direction to reduce the tension in the tire chain.

18. The method as defined in claim 17, wherein the step of rotating the adjuster tool further includes rotating the adjuster tool through about 180° for the first style vehicle tire chain tensioner or through about 90° for the second style vehicle tire chain tensioner.

19. The method as defined in claim 16, wherein the determined one of the tensioners is the first style of vehicle tire chain tensioner; and the step of engaging this first style of vehicle tire chain tensioner includes inserting a complementary free end of a leg at a first end of the adjuster tool into a recess in the first style of vehicle tire chain tensioner.

20. The method as defined in claim 16, wherein the determined one of the tensioners is the second style of vehicle tire chain tensioner; and the step of engaging this second style of vehicle tire chain tensioner includes capturing a section of the second style of vehicle tire chain tensioner in a gap defined between a first arm and a second arm extending outwardly from a second end of the adjuster tool.

* * * * *